US005734369A

United States Patent [19]

Priem et al.

[11] Patent Number: 5,734,369

[45] Date of Patent: Mar. 31, 1998

[54] METHOD AND APPARATUS FOR DITHERING IMAGES IN A DIGITAL DISPLAY SYSTEM

[75] Inventors: Curtis Priem, Fremont; Eugene Lapidous, Santa Clara, both of Calif.

[73] Assignee: NVidia Corporation, Sunnyvale, Calif.

[21] Appl. No.: 422,996

[22] Filed: Apr. 14, 1995

[51] Int. Cl.[6] ..... G09G 5/04; G09G 5/10

[52] U.S. Cl. ..... 345/155; 345/149; 345/153

[58] Field of Search ..... 345/155, 153, 345/138, 199, 149; 395/131, 132, 162

[56] References Cited

U.S. PATENT DOCUMENTS

| | | | |
|---|---|---|---|
| 3,967,052 | 6/1976 | Judice . | |
| 4,683,466 | 7/1987 | Holtey et al. | 395/131 |
| 4,730,185 | 3/1988 | Springer et al. | 345/150 |
| 4,733,230 | 3/1988 | Kurihara et al. | 345/138 |
| 4,956,638 | 9/1990 | Larky et al. | 345/199 |
| 5,138,303 | 8/1992 | Rupel | 345/155 |
| 5,201,030 | 4/1993 | Carrie | 395/131 |
| 5,301,269 | 4/1994 | Aicorn et al. | 395/162 |
| 5,341,464 | 8/1994 | Friedman et al. | 395/132 |
| 5,455,600 | 10/1995 | Friedman et al. | 345/153 |
| 5,469,190 | 11/1995 | Masterson | 345/155 |

*Primary Examiner*—Steven Saras
*Assistant Examiner*—Paul A. Bell
*Attorney, Agent, or Firm*—Stephen L. King

[57] ABSTRACT

An ordered dithering process by using different sets of dithering patterns for different color components of the source pixel color instead of using the same set of patterns. The sets of dithered patterns are designed in a way that variations in intensity due to dithering of some color components are partially or fully compensated by variations in intensity due to dithering of other color components.

10 Claims, 6 Drawing Sheets

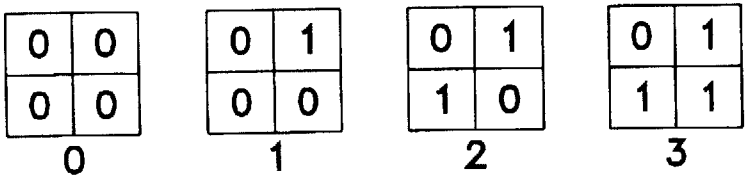
Fig. 3
| Address of pixel | X mod P | | | |
|---|---|---|---|---|
| | 0 | 1 | 2 | 3 |
| Y mod Q | 0 | 1 | 0 | 1 | 0 |
| | 1 | 0 | 1 | 0 | 0 |
| | 2 | 1 | 0 | 1 | 0 |
| | 3 | 0 | 0 | 0 | 1 |
Fig. 4
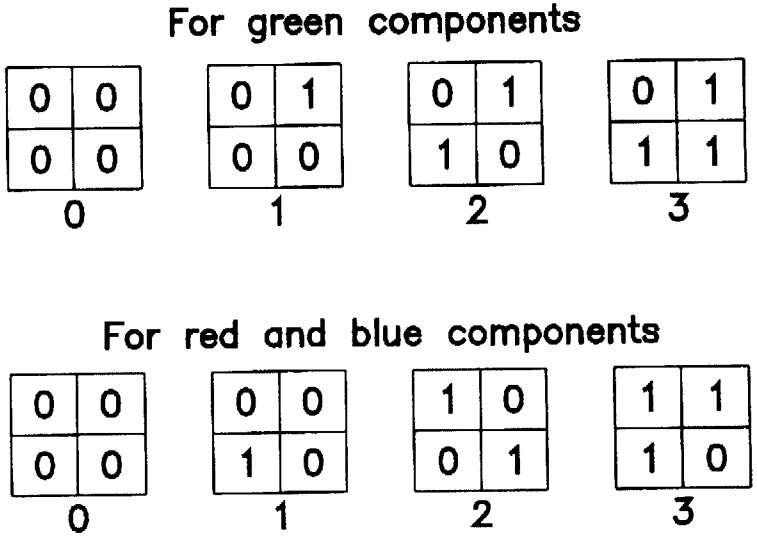
Fig. 5

| | | | |
|---|---|---|---|
| 1 | 0 | 1 | 0 |
| 0 | 1 | 0 | 0 |
| 1 | 0 | 1 | 0 |
| 0 | 0 | 0 | 1 |

| | | | |
|---|---|---|---|
| 1 | 0 | 1 | 0 |
| 0 | 0 | 0 | 1 |
| 1 | 0 | 1 | 0 |
| 0 | 1 | 0 | 0 |

METHOD AND APPARATUS FOR DITHERING IMAGES IN A DIGITAL DISPLAY SYSTEM

BACKGROUND OF THE INVENTION

1. Field of the Invention

This invention relates to computer systems, and more particularly, to a method and apparatus for dithering to improve the results produced by a reduced number of bits representing colors in the output display circuitry of digital display systems.

2. History of the Prior Art

To accurately represent a color image using digital electronics, the image is quantitized to discrete locations and colors. Typically, the image is divided into a two-dimensional grid of uniformly shaped rectangles, and each rectangle is assigned a single color. This allows a computer system to represent a color image internally as a two-dimensional array of digital color values. Images represented in this manner are known as bitmapped images. Such an array of color values can be easily stored by the computer system in a memory device. Using this form of color image representation, the computer system can easily reproduce the stored image on a color monitor or printer by means of an array of colored dots (commonly referred to as pixels).

In a typical computer system, color is quantified according to the red-green-blue (RGB) color model. According to the RGB model, colors are specified by three values corresponding to the intensities of the red, green, and blue light that must be added to form the color. Each of the intensity values varies from zero to one, with a one indicating the full intensity of the color. For example, the ordered values (1,0,1) refer to the color magenta formed by the mixture of full intensity red with full intensity blue. The RGB color model is directly applicable to color monitors in which an electron gun is used to excite red, green, and blue phosphors on a screen to varying intensities. The range of colors that can be displayed on such a device is known as the color gamut of the device. Other color quantization models are also commonly used and may be more suitable to some applications.

The perceived quality of the digitized color image when reproduced depends upon both its spatial and its color resolutions. The spatial resolution of an image is related to the number and size of the rectangles (or pixels when reproduced) into which the image is divided (and hence is related to the size of the array used to represent the image). The color resolution of an image is related to the number of discrete colors that can be simultaneously used in the image (i.e., the size of the color palette). The greater the spatial and color resolutions of an image, the better its quality. For example, an image displayed with a spatial resolution of 1024 by 768 pixels is of perceptibly higher quality than the same sized image displayed with a spatial resolution of 640 by 480 pixels. Also, an image where each color is represented by an eight bit value (allowing the use of up to 256 different color values in the same image) is of perceptibly higher quality when displayed than an image where each color is represented by a four bit value (allowing the use of only sixteen different color values).

Current high end computer systems represent color images with twenty-four bit color values (16.8 million colors) and provide a spatial resolution of 1280 by 1024 or higher. Systems with twenty-four bit color resolution are considered to be "true color" systems since the color of any pixel in the digitized image is specified with adequate color resolution to be indistinguishable from its actual color in the original image. These systems are therefore capable of reproducing images with good tonal accuracy and crispness.

There are situations, however, when it is desirable to reproduce an image that has been digitized at a certain color resolution (twenty-four bit true color, for example) using a lower color resolution. For instance, it may be desirable to utilize less expensive hardware than that required for twenty-four bit color resolution while providing a similar image quality. Cost savings while using a lower color resolution are realized mainly by decreasing the amount of expensive video memory required to store an image of the same size. For example, one twenty-four bit color pixel with eight bit red, green, and blue components usually requires twenty-four or thirty-two bits of storage memory (dependent on the design of the frame buffer); one fifteen bit color pixel with five bit red, green, and blue components usually requires only sixteen bits of storage space so that a saving of twenty five to fifty percent in the amount of expensive video memory is realized.

One well-known approach to the problem of achieving the best quality color image with a limited color resolution available relies on the ability of the eye to blend the colors of adjacent pixels so that an intermediate color is perceived. A source pixel color of high color resolution is mapped to two or more of the closest low resolution colors in the destination frame buffer such that the average error between the source pixel color and the destination colors is zero. When two or more destination colors are used alternately to represent the source color in a solid color display area, the eye blends or averages the destination colors of several neighboring pixels in the reproduced image and perceives an approximation of the original source pixel color. Two techniques that use this approach are called ordered dithering and error diffusion. These techniques are both generally referred to as dithering processes. Common steps in both these processes include truncating each of the red, green, and blue source color values by removing some L number of low order bits; obtaining an increment value (usually equal to zero or one) through the dithering process using the L bits which have been removed from each source color component; and adding the increment value to the lowest order bit of each color component of the destination color. If the dithering increment value is one, the intensity of the destination color component is greater than or equal to the intensity of the source color component; while if the dithering increment value is zero, the intensity of the destination color component is less than or equal to the intensity of the source color component.

With error diffusion, the error (a directed distance in the color model) between the actual source pixel color and the destination color to which it is dithered is calculated. This error is added to the value of each color component of those neighboring pixels which have not yet been processed. A dithering increment value is set to one if the value of the L low order bits of the resulting color component is greater than or equal to half of their maximal value or is set to zero if the value of the L low order bits is less. The main disadvantage of the most common method for practicing error diffusion is the relatively large number of computations that have to be performed for each pixel and, as a result, the slow overall performance of the process. Various methods have been used to speed up the error diffusion process, but these methods also require complex color calculations involving multiple handling of the same data or the use of an intermediate storage buffer and result in slow rendering performance.

With the ordered dithering technique, a set of patterns of zeros and ones in a rectangle of size P by Q is designed, where the size of the rectangle is equal to or larger than the number of levels of intensities to be dithered (the number of levels is equal to 2 to the power L) and the number of patterns in the set is equal to the number of levels of intensities to be dithered. Each pattern in a set is assigned to a particular level of low order bits of the color component to be dithered so that the ratio of positions filled with ones to all positions in the pattern is equal to the ratio of the value of low order bits to the number of intensities to be dithered. Typically, the patterns in a set are arranged in an order such that the number of patterns in a set, starting from 0, is equal to the value of low order bits to be dithered. In the process of dithering, Cartesian coordinates of the destination pixel (X,Y) are used to locate a position in the pattern square as (X mod P, Y mod Q). For a particular value of low order bits of the color component to be dithered, the value of the dithering increment is obtained from the location of the pixel in the pattern assigned to this value of low order bits. Ordered dithering allows each destination pixel to be processed based only on position and source color, therefore making possible fast and efficient hardware implementations.

The main disadvantage of the ordered dithering approach is that in some visual conditions it produces visible artifacts related to variations of brightness of the pixels in image areas having a constant intensity of source color. The visibility of brightness variations of the same amplitude becomes lower with the decrease of the average distance between pixels having brightness different from the value of brightness of the majority of the pixels in the area representing constant color to be dithered and with the decrease in variations of this distance across the image. One known way to decrease visibility of brightness variations is to design a set of dithering patterns with a goal to avoid some of the artifacts, such as visible horizontal, vertical or diagonal lines; another known way is to use rotation of the dithering patterns relative to the Cartesian coordinate system of the image on display. Both solutions decrease perceived coherency of brightness variations in the dithered areas of the image and variations of the distance between pixels with different brightness. However, none of these known improvements decreases the amplitude of brightness variations or the average distance between pixels with different brightness.

SUMMARY OF THE INVENTION

It is, therefore, an object of the present invention to maximize the color quality of images reproduced at lower color resolutions by decreasing average amplitude of brightness variations in the areas that represent source colors of constant intensity.

It is another object of present invention to minimize the visibility of brightness patterns by decreasing the average distance between pixels having brightness different from the value of brightness of the majority of the pixels in the area representing constant color to be dithered.

These and other objects of the present invention are realized in an ordered dithering process by using different sets of dithering patterns for different color components of the source pixel color instead of using the same set of patterns. The sets of dithered patterns are designed in a way that variations in brightness due to dithering of some color components are partially or fully compensated by variations in brightness due to dithering of other color components.

These and other objects and features of the invention will be better understood by reference to the detailed description which follows taken together with the drawings in which like elements are referred to by like designations throughout the several views.

BRIEF DESCRIPTION OF THE DRAWINGS

FIG. 3 illustrates a set of patterns of increments which may be used in an ordered dithering process.

FIG. 4 illustrates a single pattern of increments which may be used in an ordered dithering process FIG. 5 illustrates a set of patterns which may be used in an ordered dithering process in accordance with present invention.

NOTATION AND NOMENCLATURE

Some portions of the detailed descriptions which follow are presented in terms of symbolic representations of operations on data bits within a computer memory. These descriptions and representations are the means used by those skilled in the data processing arts to most effectively convey the substance of their work to others skilled in the art. The operations are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary or desirable in most cases in any of the operations described herein which form part of the present invention; the operations are machine operations. Useful machines for performing the operations of the present invention include general purpose digital computers or other similar devices. In all cases the distinction between the method operations in operating a computer and the method of computation itself should be borne in mind. The present invention relates to a method and apparatus for operating a computer in processing electrical or other (e.g. mechanical, chemical) physical signals to generate other desired physical signals.

Further, the terms "intensity" and "brightness" as used in the text below are used interchangeably to mean a measure of the energy of light emitted or reflected by a given pixel in all visible spectra, as contrasted to the color of the pixel, representing the spectral distribution of emitted or reflected light.

DETAILED DESCRIPTION

Figure 1:
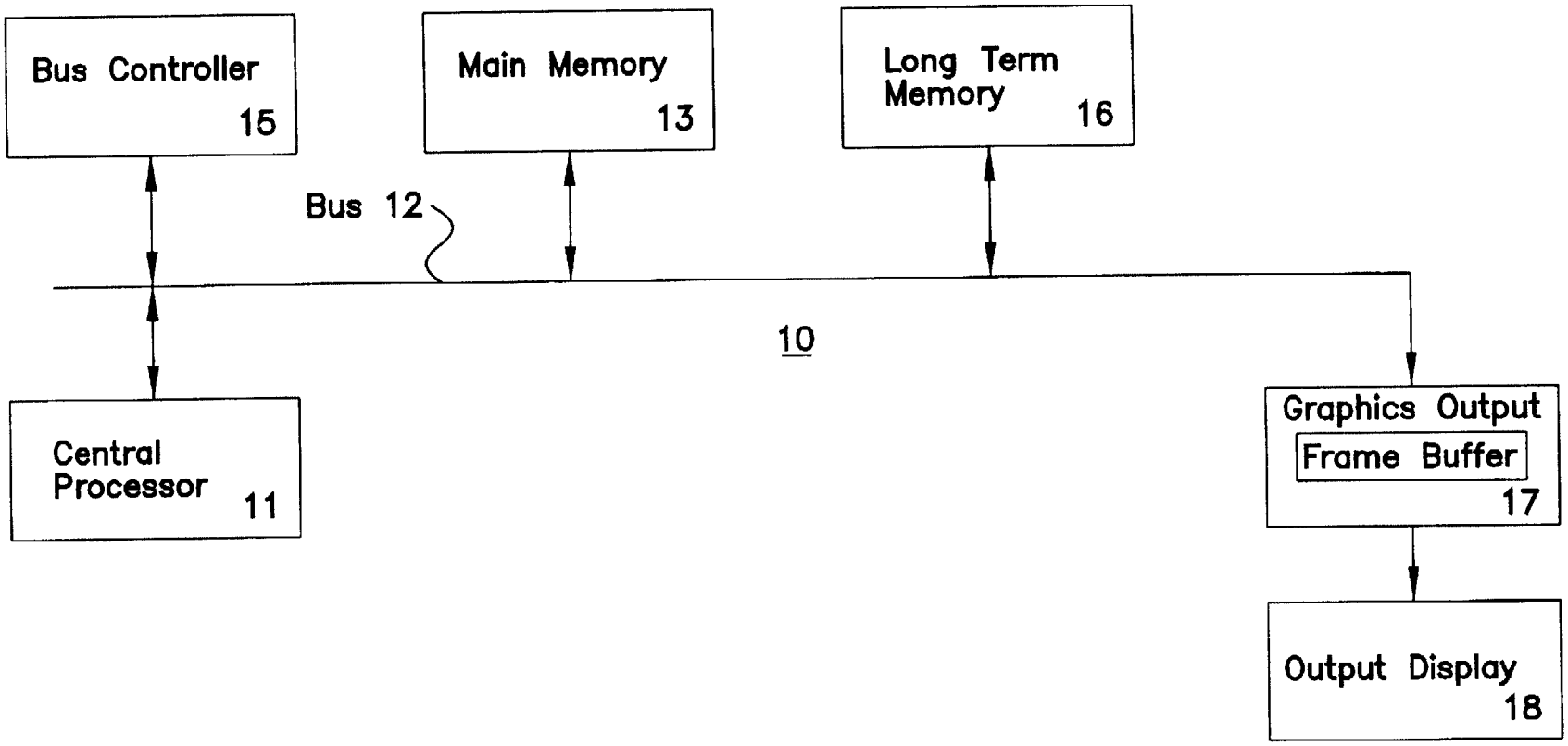
FIG. 1 is a block diagram of a computer system utilizing the present invention.

Referring now to FIG. 1, there is illustrated a computer system 10. The system 10 includes a central processing unit 11 which executes the various instructions provided to control the operations of the computer system 10. The central processing unit 11 is joined to a bus 12 adapted to carry information to various components of the system 10. Joined to the bus 12 is main memory 13 which is typically constructed of dynamic random access memory arranged in a manner well known to those skilled in the prior art to store information during a period in which power is provided to the system 10. Also connected to the bus 12 are a bus controller 15 various peripheral components such as long term memory 16 and circuitry such as a graphics control circuit 17 which may include a frame buffer to which data may be written which is to be transferred to an output device such as a monitor 18 for display. A graphics control circuit such as the circuit 17 is typically utilized to control the transfer and manipulation of pixel data to be displayed. Such a circuit may include circuitry designed in accordance with the present invention to improve the image presented when a reproduced image uses a smaller number of bits to represent each pixel than occurs in an original image representation.

Figure 2:
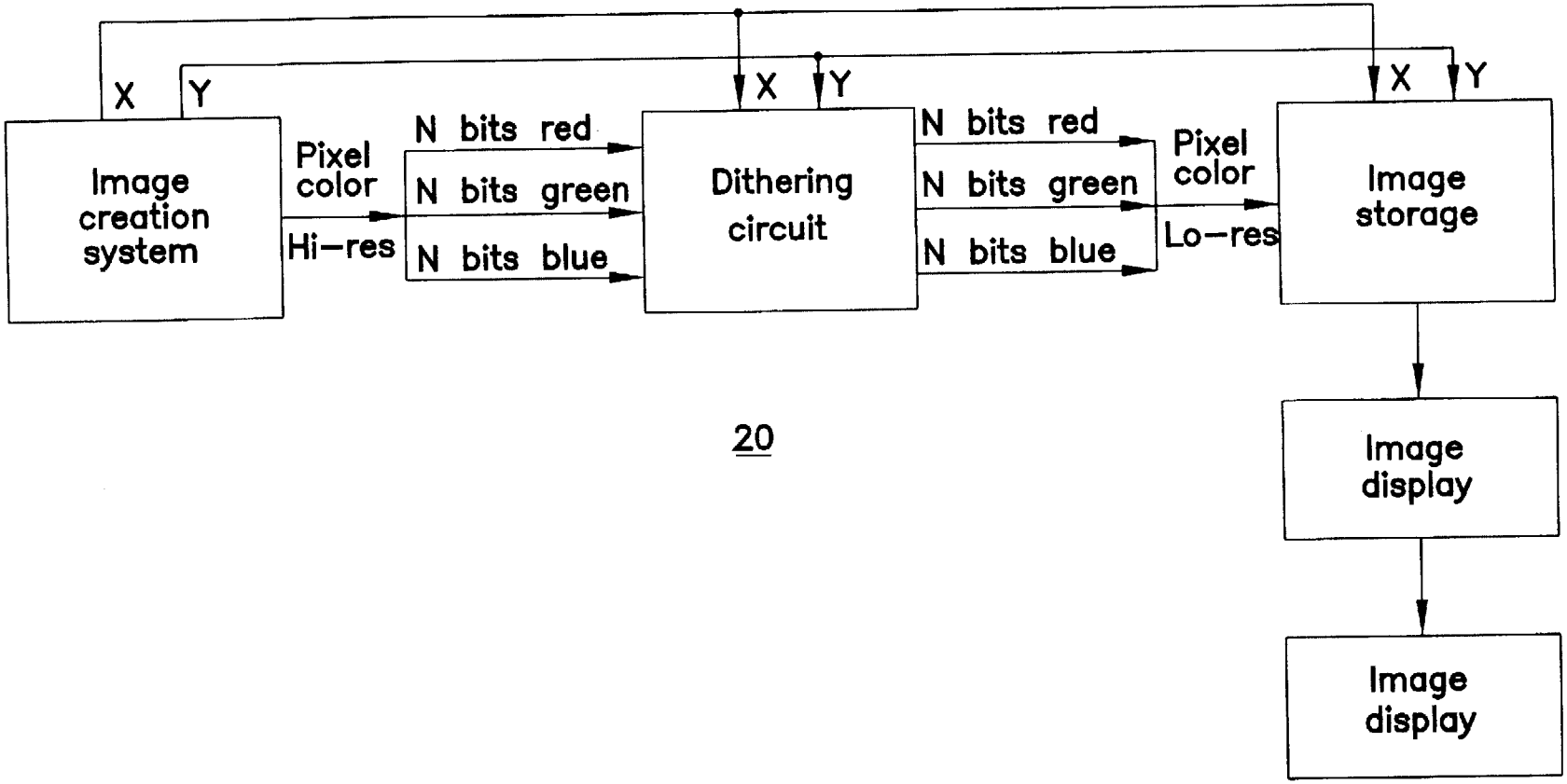
FIG. 2 is a block diagram illustrating a circuit for reproducing an image originally represented by pixels with color components having a greater number of bits by pixels with color components having a lesser number of bits.

As is set forth above, dithering is a technique which may be used when it is desirable to reproduce at a lower color resolution an image that has been digitized at a high color resolution while retaining the color quality of the image. For example, in reproducing an image in a fifteen bit color format which was originally represented in twenty-four bit true color format, each of the three red, green, and blue colors must be reduced from eight bits to only five bits. To do this, the three lower order bits of the eight bit representations are dropped (truncated) but the value represented by the three bits which are dropped is then evaluated and result of such evaluation is added to the lowest order remaining bits. This evaluation and adding are done by a dithering process. FIG. 2 shows a block diagram of a generalized circuit 20 for reproducing an image using pixels having a lesser number of bits M representing the color values originally represented by pixels values having a greater number of bits N representing the color values.

In ordered dithering, a number of rectangular patterns may be used to represent the various possible values for the lower order bits which are truncated. To achieve the best accuracy in representing the truncated bits, each pattern has a number of cells which is greater or equal to the number of values that may be represented by the truncated bits. If, for example, two bits are truncated, at least four values are possible so a two by two rectangle with four positions is described. The positions in the rectangle are filled by ones and zeros to produce patterns for all of the possible values (0–3) for the truncated bits. A set of such patterns is illustrated in FIG. 3. Typically, the number of patterns in the set is equal to the number of values that may be represented by the truncated bits. Since there are four possible values which may be represented by the two truncated bits in the example, four individual patterns are constructed.

Once the patterns which are to be used to represent the values of the truncated bits have been selected, the particular value of the increment to be applied to a color component of a pixel at any particular position on the display is determined. This is accomplished by using the horizontal and vertical Cartesian coordinates of the pixel being described. The horizontal position in the pattern is arrived at by dividing the pixel position X on the display (or in a display window) by the value P which is equal to the size of the rectangular pattern in the horizontal direction and utilizing the remainder (X mod P) as the value of the horizontal position in the pattern. The vertical position (Y mod Q, where Q is equal to the size of the rectangular pattern in the vertical direction and is typically equal to P) is arrived at in a similar manner. Using this selection criteria, the value in the pattern at the intersection of the (X mod P) and (Y mod Q) positions is selected as the increment to be added to color values at a particular pixel position on the display. FIG. 4 illustrates position selection in a single exemplary four by four pattern representing three truncated bits and therefore requiring at least eight positions for increment values. When the number of possible positions in the pattern is equal to or larger than the number of possible values of truncated bits, for each particular value of truncated bits the ratio of the number of positions holding increment value one to the number of total positions in the pattern is typically set to be equal to the ratio of the value of truncated bits to the number of all possible values of truncated bits. For example, a value of three out of eight possible values of three truncated bits can be represented by a four by four pattern with ones in six positions out of sixteen.

In order to illustrate the process of increment selection using the patterns illustrated in FIG. 3 which represent only two truncated bits, presuming that the pixel of interest is the fifth pixel from the left on the third scan line from the top, the horizontal position is position one of the two possible horizontal positions zero and one; and the vertical position is position one of the two possible vertical positions zero and one. Similarly, for the bit position on the same scan line but immediately to the right of the pixel just described, the horizontal position is position zero of the two possible horizontal positions zero and one; and the vertical position is position one of the two possible vertical positions. For the bit position on the next scan line immediately below the pixel first described, the horizontal position is position one of the two possible horizontal positions zero and one; and the vertical position is position zero of the two possible vertical positions.

The value of the truncated bits determines which of the four patterns (with two truncated bits) is utilized to select an incremental value to be added to the lowest order bit of the truncated color value. If the truncated bits have a value of zero, the pattern to the left is utilized; if the value is one, the next pattern is utilized; and so on. The values of the patterns in each of the rectangles may be stored as truth tables or in some other manner so that they are available to the graphics control device.

Thus, each time a pixel is to be placed in a position on the display, its position in the dithering pattern is determined (in the manner described with respect to FIG. 4). Then, for each source color component, the value of the destination color component is obtained by truncating a selected number of low order bits; the dithering pattern of zeros and ones is selected from the set of available patterns, the pattern having a ratio of positions filled with ones to all positions equal to the ratio of the value of the low order bits to the number of all possible values of bits; and a value equal to zero or one is obtained of an element of the selected pattern at a position within the pattern as described above; and the value is added to the destination color component.

In the case of a constant source color, the average value of destination color components for pixels covering all positions in the dithering pattern is equal to the value of the original source color component represented because the ratio of positions filled with ones in the selected pattern to all positions is equal to the ratio of the lower bit value truncated from the source color component to the number of all possible lower bit values.

Therefore, if brightness variations in the areas representing constant color are small enough for the human eye to blend colors together, every such area filled with dithered low resolution destination colors will contain exactly the same blended color as an area filled with the constant high resolution source color.

Because the eye is more sensitive to changes in brightness than to changes in color, the quality of the dithered image can be measured by characterizing the brightness variations in the areas that represent a constant source color with high resolution color components. The most complete way to present such characterizations is in a form of amplitude spectrum of brightness in the frequency domain. To provide simple measures of dithering quality, two sets of parameters may be used: a first set describing the amplitude distribution of brightness variations, a second set describing the space distribution of brightness variations across areas of the image.

Average amplitude of brightness variations may be calculated as a mean deviation of brightness values in the given area from the average brightness level (which is equal to the brightness of the constant source color). The quality of the dithered image increases with a decrease in the average amplitude of brightness variations, making neighboring pixels representing the same source color differ less from each other.

The space distribution of brightness variations can be measured by the average distance between pixels having a brightness different from the value of brightness of the majority of the pixels in the area representing constant color to be dithered. This average distance is proportional to the square root of the ratio of the number of all pixels in the evaluated area to the number of pixels having a brightness different than the brightness of the majority of the pixels in this area. The quality of the dithered image increases with a decrease in the average distance between pixels with different brightness, because the human eye can more easily blend colors of such pixels together when the distance between them becomes smaller. Another parameter that affects perception of image quality is an amplitude of variations in the distance between pixels of different brightness (or an amplitude of variations in the space density of such pixels). The lower the amplitude of such variations, the better is the perception of uniformity in the areas representing constant source color.

In the known implementations of ordered dithering, color components of each pixel can either have values which are all equal, greater, or less than values of corresponding color components of the constant source color to be dithered. The ratio of pixels with increased brightness to all pixels should be equal to the ratio of the value of truncated bits to the number of all possible values of truncated bits to make the average values of color components equal to the values of source color components. Therefore, in the known implementations of ordered dithering, average amplitude of brightness variations is defined by the number of pixels with different brightness that are necessary to represent source color and can not be adjusted. Similarly, average distance between pixels with different brightness is controlled by the density that is necessary to represent source color and also can not be adjusted. Only variations in distance between pixels with different brightness may be optimized, mainly by using dithering patterns of different designs. As a result, intensity variations in some visual conditions retain high visibility, decreasing the overall quality of the dithered image.

In order to overcome the restrictions imposed by known implementations of the dithering process and to improve the quality of the image, improved apparatus and an improved method are proposed in accordance with the present invention, which are based on the use of two or more sets of dithering patterns for dithering different color components instead of a single set of dithering patterns for all color components.

The detailed description of the preferred embodiment of the invention may be better understood using a well-known representation of an intensity, or brightness, I of a pixel with R, G, and B color components as a weighted sum of these components:

$I=(A0*R)+(A1*G)+(A2*B)$, where the weights A0 . . . A2 are based on the chromaticity parameters of the display monitor, such as white point. The two most widely used sets of weights are A0=0.299; A1=0.587; A2=0.114, used for television and computer monitors, and A0=0.212; A1=0.701; A2=0.087, used for high-definition television and advanced computer monitors.

These sets of weights reflect the fact that the green component of color has the greatest influence on the overall intensity of the pixel, while the blue component has the lowest influence, and the red component is in the middle. Such distribution reflects the spectral-response functions of each of the three types of cones of the human retina. Of particular interest is the fact that in the two sets of weights, the sum of the weights of the red and blue components is lower than the weight of the green component.

The present invention makes use of the fact that the human eye is more sensitive to the intensity of light than to its color. For example, judging the color of an object subtending less than twenty to forty minutes of arc (which corresponds to about seven pixels of height on a 1024-line display with a vertical height fifteen inches, viewed from a typical distance of twenty-four inches) is very difficult; while variations of intensity can be perceived even for single pixels on the same display.

Based on this, one embodiment of the invention uses two different sets of dithering patterns, one for green and another for blue and red components. These two sets of patterns are designed in a way that, for a maximal possible number of pixel locations, when the green component of the destination color is larger than the green component of the source color, the blue and red components of the destination color are smaller than the similar components of the source color, and vice versa. In the simplest case of truncating and dithering two low order bits (as in dithering of eight bit color component to a six bit color component) to produce the described compensation of intensity variations, a set of patterns used for the green component may be as shown in the upper portion of FIG. 5 while a set of patterns for the red and blue components may be those illustrated in the lower portion of FIG. 5. By using two sets of patterns, at some positions on the display the increase of intensity of the destination pixel caused by the green component is compensated by the simultaneous decrease of the sum of the intensities of the red and blue components, and vice versa. This results in a smaller average amplitude of variations of intensity. At the same time, it increases the number of pixels having a value of brightness which is different from the value of brightness of the majority of the pixels in the area representing constant color to be dithered. This happens due to the substitution of some pixels having the same brightness (all color components are incremented by the same values) by pixels with different levels of brightness (color components incremented by different values). Therefore, the use of different sets of patterns for different color components decreases the average distance between pixels which brightness is different from the value of brightness of the majority of the pixels in the area representing constant color to be dithered.

Use of different sets of dithering patterns for different color components, while optimizing brightness variations, may cause an increase in variations of color. For instance, if a source pixel color is gray (i.e., the red, green, and blue components have the same values), an area of low color resolution pixels dithered accordingly to the present invention will be composed of pixels with slightly different colors (with the green color component being larger or smaller than the blue and red color components).

Decrease of brightness variations and a corresponding increase of color variations may be demonstrated in the following example of two pixels of the same gray color. If these pixels are dithered using a single pattern with element 0 at the first pixel position and element 1 at the second pixel position, all destination color components of the first pixel are not incremented, while all destination color components of the second pixel are incremented by 1. The difference in intensity between these pixels is equal to one, and the color of all pixels remains gray (color components are equal to each other). If the same two pixels are dithered in accordance with the present invention, the first pattern with element 0 at the first pixel position and element 1 at the second pixel position is used for green color components, while a second pattern with element 1 at the first pixel position and element 0 at the second pixel position is used for red and blue color components. In this case, the first pixel has its red and blue color components incremented (the intensity of the first pixel is increased by A0+A2), while the second pixel has its green color component incremented (the intensity of the second pixel is increased by A1). The difference in intensity between the first and second pixels is equal to (A1−A0−A2), which value is typically in the range from 0.174 to 0.402. Therefore, variations in intensity of neighboring pixels dithered according to the present invention can be more than two times smaller than when a prior art dithering algorithm is used. At the same time, colors of the first and second pixel become slightly different, due to different ratios of intensities of green and red, blue components.

An overall increase of image quality resulting from the use of present invention is based on the above-mentioned fact that the eye is less sensitive to variations of color than to variations of intensity. In the practically important case of dithering from twenty-four bit color (eight bit values of color components) to fifteen bit color (five bit values of color components), the difference in color between the destination pixels used to represent the source pixels of the same color is not perceivable in most visual conditions for standard display resolutions varying from 640 by 480 to 1280 by 1024 pixels; while variations in intensity between such destination pixels decrease significantly, in some conditions below the level of human perception, thereby increasing the overall quality of the image and making it look very close to the image created with twenty-four bit color pixels.

Figures 6A, 6B, 6C, 6D, 6E:
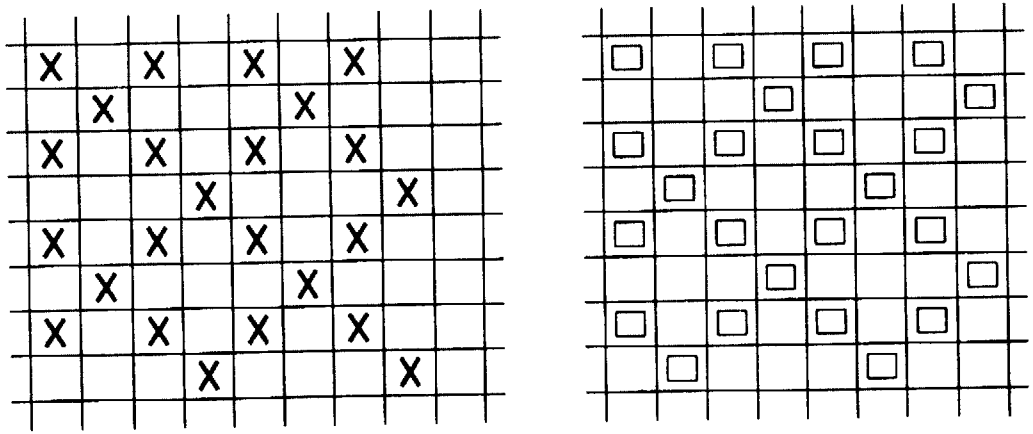
FIG. 6 (*a–e*) are illustrations of the use the patterns in accordance with the present invention.

FIGS. 6*a* and 6*b* illustrate a pair of patterns for dithering of green and red/blue color components in another embodiment of the present invention. Both patterns may be utilized in a dithering process that involves truncation of three bits (for instance, from 8-bit color components to 5-bit color components) which is used when the value of truncated bits is equal to three (ratio of positions filled with "1" to all positions in each pattern is equal to three-eighths). FIGS. 6*c* and 6*d* represent a larger area of the display covered by tiled patterns shown on FIGS. 6*a* and 6*b* (each pattern is repeated two times in the horizontal and vertical directions to show the symmetry of the field of increments. Blank spaces correspond to pattern elements 0, crosses and squares correspond to pattern elements 1). As may be seen from FIGS. 6*c* and 6*d*, both patterns have the same symmetry; the infinite field of increments corresponding to pattern for green component may be transformed into the infinite field of increments corresponding to red/blue components by shifting it two positions in the horizontal or vertical direction. Therefore, when dithering pixels requiring only one set of patterns (for instance, having pure red, green, or blue colors), both patterns produce fields with the same average distance between pixels having a brightness value which is different from the value of brightness of the majority of the pixels in the area representing constant color to be dithered. FIG. 6*e* represents a superposition of tiled patterns for green components over tiled patterns for red/blue components where both patterns are needed to dither pixels having colors with green and red/blue components. As may be seen from FIG. 6*e*, one out of each three positions having an increment 1 for the green component has an increment 0 for the red/blue components, and vice versa. Therefore, in this example larger intensities of green components are compensated by smaller intensities of red/blue components for one-third of all positions with increment 1, thereby decreasing the average amplitude of intensity variations. As is also illustrated by FIG. 6*e*, the combination of two dithering patterns creates a field with half the average distance between pixels having brightness different from the value of brightness of the majority of the pixels in the area representing the constant color to be dithered (in this case, the largest group of pixels having the same brightness occupies positions with increments 0 for all color components, those positions being represented by blank spaces on FIGS. 6*c*, 6*d*, and 6*e*). The same results, decrease in the average amplitude and in the period of intensity variations when using combinations of different patterns in the areas representing constant source color, may also be seen for the sets of patterns shown in FIG. 5.

Figure 7:
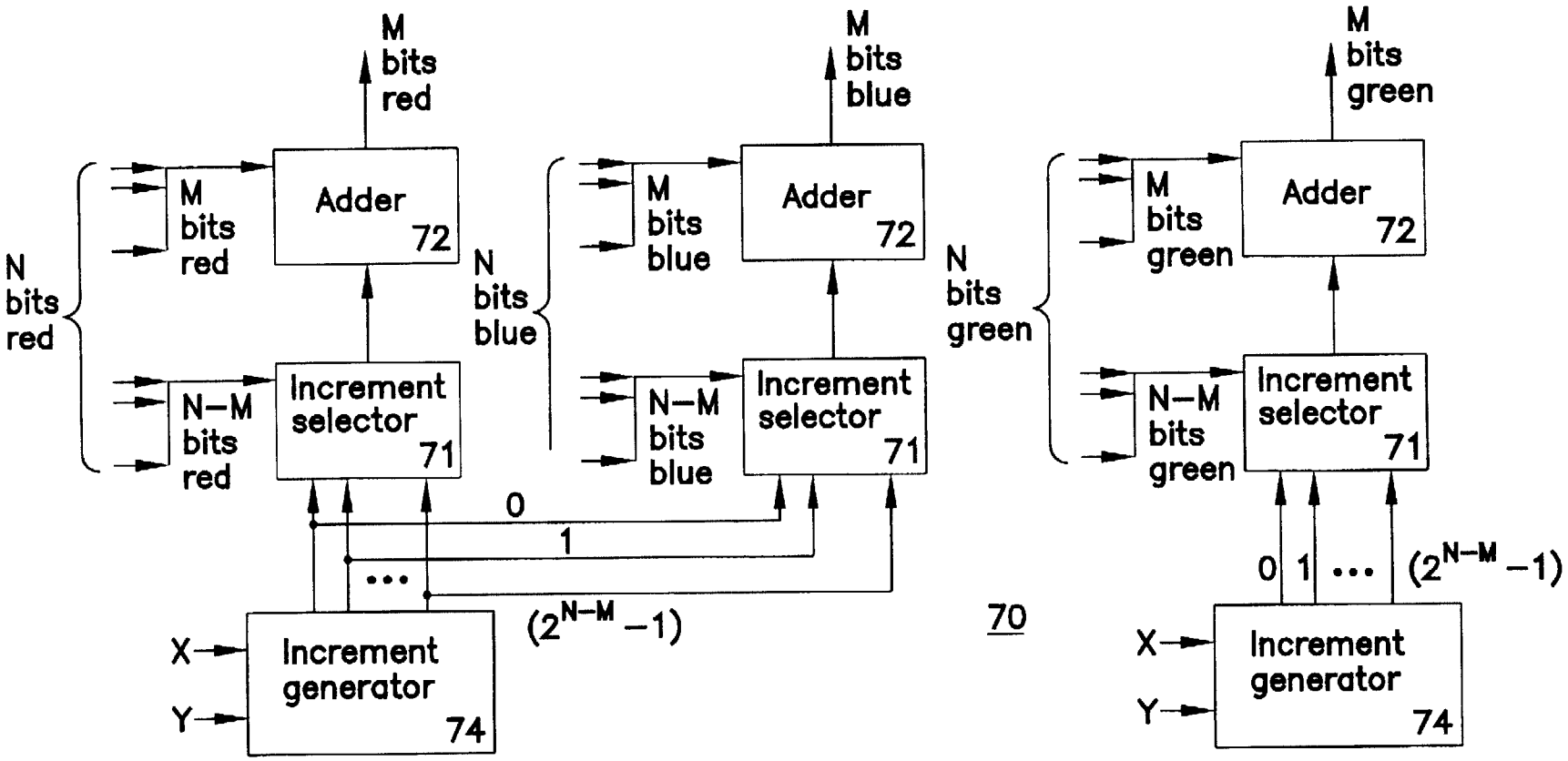
FIG. 7 is a block diagram illustrating circuitry of a dithering circuit which may be used to practice the invention.

FIG. 7 illustrates a dithering circuit 70 which may be used in the circuit of FIG. 2 to practice the invention. As may be seen the circuit 70 includes three adder circuits 72, three increment selector circuits 71 (one for each of the three components red, green, and blue) and two increment generator circuits 74 (one for red and blue, another for the green component). An increment generator 74 receives the X and Y Cartesian coordinates of the current pixel to be drawn on the screen, uses these coordinates to calculate the position of the element that has to be retrieved from the dithering pattern, obtains values stored at this position in all patterns of the set used for dithering of corresponding color components (the number of patterns in the set being equal to the number of intensity levels of truncated bits), and supplies these values to the increment selector. The increment selector circuit 71 receives the lower order bits being truncated from the higher resolution color component of N bits during generation of the lower resolution color component of M bits, calculates the value of the number composed of the bits, selects the increment generated by the increment generator from the pattern which number is equal to this value, and supplies the selected increment to the adder. One possible implementation of the selector circuit 71 is a simple switch the design of which is well known to those skilled in the art. The adder circuit 72 adds the increment value to the low bit of the remaining M bits and furnishes the final color value for the particular component color. The design of such an adder circuit is also well known to those skilled in the art.

Figure 8:
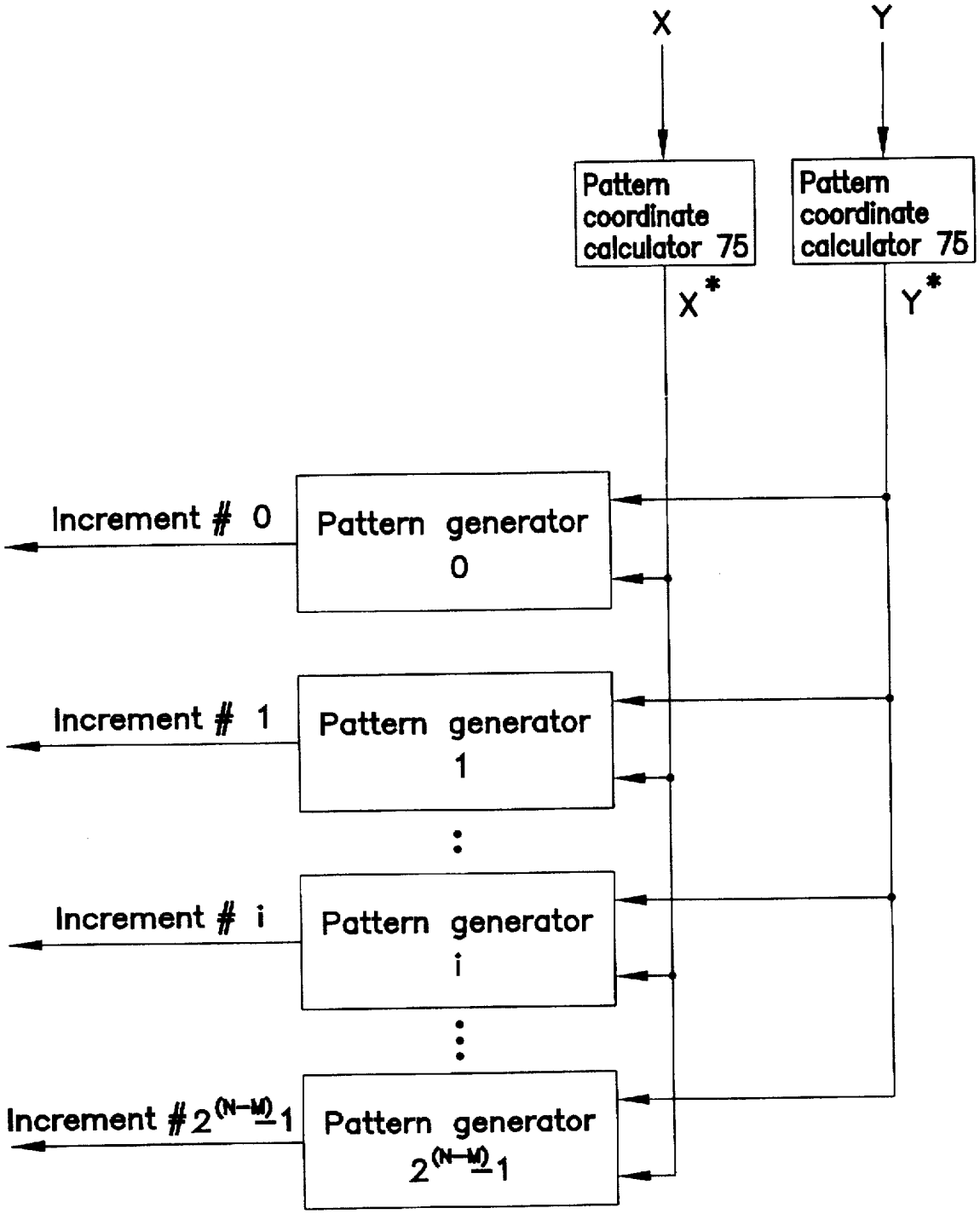
FIG. 8 is a block diagram illustrating circuitry of an increment generator which may be used to practice the invention.

FIG. 8 illustrates an increment generator 74 which may be used in the circuit of FIG. 7 to practice the invention. As may be seen, an increment generator includes two pattern coordinate calculators 80 (one for each coordinate) and pattern generators 81 of a number equal to the number of values of bits truncated from the high resolution color component of N bits to produce the low resolution color component of M bits (two in degree of (N–M)). Each pattern coordinate calculator 80 performs the operation (C mod G) , where C is the value of the coordinate and G is the size of the pattern along this coordinate. Circuitry to perform such an operation is well known to those skilled in the art; for example, in the practically important case where the value of pattern size is equal to two in an integer degree (2, 4, 8, etc.), this circuitry performs an AND operation between C and (G-1). Each pattern generator 81 generates the value of the element stored in the pattern of the corresponding number at the supplied coordinates. Two implementations of such a pattern generator are possible, each of which is well known to those skilled in the art: a memory buffer with two-dimensional access to the dam, and a net of logical gates generating a truth table based on the pattern coordinate input values.

The possible embodiments of the present invention are not to be considered to be limited by the described implementation.

The invention can be implemented as a sequence of central processing unit operations which include representing the sets of designed patterns as matrices or look-up tables, obtaining the number of a current matrix as equal to the value of the truncated bits to be dithered, and obtaining the dithering increment value as an element of the matrix with the row and column using the rood function and the Cartesian pixel coordinates.

More than one set of patterns can be used for each of the green, red, and blue components; and the patterns for different components may be used interchangeably. For instance, to decrease the coherency of intensity patterns, green components may use a first set of patterns in some areas of the image while red and blue components use a second set of patterns; in other areas of the image, the green components may use the second set of patterns while the red and blue use the first set. In one particular embodiment of the invention, the decision of which set of patterns to use may be made based on the values of the higher bits of the Cartesian pixel coordinates, thereby effectively increasing the size of the pattern grid. However, other embodiments of the invention are possible where the decision of which set of patterns to use is not based on coordinates alone and uses other inputs such as time or image characteristics, for example.

Patterns for different color components can also be designed to accomplish goals other than the effective minimization of variations in intensity. Experiments show that in dithering four or more bits of each components (e.g., twenty-four bit color with eight bit components to twelve bit color with four bit components), sets of patterns that optimally minimize intensity variations make adjacent pixels in the areas that represent gray color source may perceivably differ in color. To minimize the negative effect of color variations, it is possible, in accordance with spirit of present invention, to use sets of patterns which differ from each other at less than maximal possible number of positions but are not completely identical, or to use different patterns only for specific values of truncated bits and destination color components.

In the embodiments of the invention which are illustrated, the sets of dithering patterns are identical for blue and red components. However, in general, sets of patterns for all three components can be different. It is also possible to utilize patterns which can be other than square or rectangular.

The present invention applies not only to red, green, and blue components of the RGB color space; the same approach is also applicable to other color spaces, such as HSV or YUV. In the case of YUV color space, where color is represented in terms in luminosity (Y) and two color differences (U and V), the Y component may be dithered using one set of patterns while the U and V components may be dithered using another set of patterns to compensate for variations in intensity.

Although the present invention has been described in terms of a preferred embodiment, it will be appreciated that various modifications and alterations might be made by those skilled in the art without departing from the spirit and scope of the invention. The invention should therefore be measured in terms of the claims which follow.

What is claimed is:

1. In a method for practicing dithering to reproduce at a lower color resolution an image that has been digitized at a higher color resolution including the steps of:

truncating each color component by removing a specified number of lower order bits, obtaining an increment value from a data set for each color component, using a value of bits truncated from the color component to select a single element from the data set, modifying each truncated color component by the increment value, the additional step of using different data sets of equal size to obtain increments for different color components of the pixel, in which the additional step of using different data sets of equal size to obtain increments for different color components of the pixel includes using a first data set to obtain increments for a color component having a greatest influence on the intensity of the pixels which differs from other data sets used to obtain increments of other color components.

2. In a method as claimed in claim 1 in which the additional step of using different data sets of equal size to obtain increments for different color components of the pixel includes using a second data set to obtain increments for all color components other than a color component having a greatest influence on the intensity of the pixels.

3. In a method as claimed in claim 2 in which the additional step of using different data sets of equal size to obtain increments for different color components of the pixel includes using a first data set which has elements corresponding to some values of truncated bits and pixel coordinates that are different from an elements of a second data set corresponding to the same values of truncated bits and pixel coordinates, and an average value of elements in the first data set calculated at a constant value of truncated bits over all pixel coordinates in an area of the image is the same as an average value of elements in the second data set calculated at the same value of truncated bits over the same area of the image.

4. In a method as claimed in claim 2 in which the additional step of using different data sets of equal size to obtain increments for different color components of the pixel includes using a first data set to obtain increments for a green color component different from a second data set used to obtain increments for red and blue color components.

5. A method for practicing ordered dithering to reproduce at a lower color resolution an image that has been digitized at a higher color resolution including the steps of: truncating each color component of a pixel by removing a specified number of lower order bits, using sets of patterns of ones and zeros to represent values of truncated bits of color components in which the patterns used for identical values of different color components are of equal size but differ in the positions of the ones and zeroes, using a value of the truncated bits to select a pattern from a set of patterns of ones and zeros representing the value of an increment which sets of patterns differ for the different color components, using pixel display position to choose an increment value from a selected pattern, and modifying each truncated color component by the increment value.

6. A method as claimed in claim 5 in which a set of patterns representing a color component having a greatest influence on intensity of the pixels differs in the positions of the ones and zeroes from sets of patterns representing other color components.

7. A method as claimed in claim 6 in which the sets of patterns representing other than a color component having a greatest influence on intensity of the pixels are the same.

8. A method as claimed in claim 5 in which different patterns used to represent the same values of truncated bits for different color components have the same ratios of positions filled with ones to a whole number of positions in the pattern.

9. Apparatus for practicing ordered dithering to reproduce at a lower color resolution an image that has been digitized at a higher color resolution comprising:

means for truncating each color component of a pixel by removing a specified number of lower order bits, means providing sets of patterns of ones and zeros to represent values of truncated bits of color components in which the patterns used for different color components are of equal size but differ in the positions of the ones and zeroes, in which a set of patterns representing a color component having a greatest influence on intensity of the pixels differs in the positions of the ones and zeroes from sets of patterns representing other color components, means for using a value of the truncated bits to select a pattern from a set of patterns of ones and zeros representing the value, means for selecting a position of an element in a pattern which contains an increment value using pixel display position, and means for modifying each truncated color component of the pixel using an increment value obtained from the selected pattern at the selected position.

10. Apparatus as claimed in claim 9 in which the sets of patterns representing other than a color component having a greatest influence on intensity of the pixels are the same.

* * * * *